US007683898B2

(12) United States Patent
Park et al.

(10) Patent No.: US 7,683,898 B2
(45) **Date of Patent: *Mar. 23, 2010**

(54) HIGHLY EFFICIENT LCD DRIVING VOLTAGE GENERATING CIRCUIT AND METHOD THEREOF

(75) Inventors: Jae-ho Park, Yongin (KR); Hyoung-rae Kim, Suwon (KR)

(73) Assignee: Samsung Electronics Co., Ltd. (KR)

( * ) Notice: Subject to any disclaimer, the term of this patent is extended or adjusted under 35 U.S.C. 154(b) by 743 days.

This patent is subject to a terminal disclaimer.

(21) Appl. No.: 11/540,292

(22) Filed: Sep. 29, 2006

(65) Prior Publication Data

US 2007/0024555 A1 Feb. 1, 2007

Related U.S. Application Data

(63) Continuation of application No. 10/417,585, filed on Apr. 17, 2003, now Pat. No. 7,133,038.

(30) Foreign Application Priority Data

Apr. 23, 2002 (KR) ..... 02-22323

(51) Int. Cl.
*G09G 5/00* (2006.01)

(52) U.S. Cl. ..... 345/204

(58) Field of Classification Search ..... 345/87–100, 345/208–214, 204

See application file for complete search history.

(56) References Cited

U.S. PATENT DOCUMENTS

| | | | | |
|---|---|---|---|---|
| 4,859,911 | A | 8/1989 | Kinnard et al. | 315/169.3 |
| 5,532,718 | A | 7/1996 | Ishimaru | |
| 6,335,713 | B1 * | 1/2002 | Imai | 345/76 |
| 7,133,038 | B2 * | 11/2006 | Park et al. | 345/211 |
| 2002/0036636 | A1 * | 3/2002 | Yanagi et al. | 345/211 |
| 2005/0156854 | A1 * | 7/2005 | Park et al. | 345/100 |

FOREIGN PATENT DOCUMENTS

| | | |
|---|---|---|
| JP | 3-025491 | 4/1991 |
| JP | 6-253535 | 9/1994 |
| JP | 9-318927 | 12/1997 |
| JP | 11-136601 | 5/1999 |

* cited by examiner

*Primary Examiner*—Richard Hjerpe
*Assistant Examiner*—Mansour M Said
(74) *Attorney, Agent, or Firm*—Mills & Onello, LLP

(57) ABSTRACT

A highly efficient LCD driving voltage generating circuit and method consumes a relatively small amount of power, as compared to conventional means. The LCD driving voltage generating circuit comprises a DC-DC converter for boosting an input voltage in response to a clock signal and for outputting the boosted voltage as a first driving voltage; a voltage controlled oscillator for generating the clock signal at a frequency that changes in response to the level of a control voltage; and a control voltage generator for generating the control voltage in response to the difference between a reference voltage and a feedback voltage derived from the first driving voltage. In this manner, as the feedback voltage becomes lower than a reference voltage, the frequency of the clock signal input into a DC-DC converter increases. If the feedback voltage is lower than a predetermined voltage, this indicates that the level of the first driving voltage is lower than a predetermined value, and thus current consumption of the LCD panel is large. It is possible to decrease power consumption and increase boosting efficiency by changing the frequency of the clock signal used for boosting of a DC-DC converter according to the current consumption of the LCD panel.

16 Claims, 8 Drawing Sheets

HIGHLY EFFICIENT LCD DRIVING VOLTAGE GENERATING CIRCUIT AND METHOD THEREOF

RELATED APPLICATION

This application is a continuation of U.S. application Ser. No. 10/417,585, filed on Apr. 17, 2003 now U.S. Pat. No. 7,133,038, which relies for priority upon Korean Patent Application No. 02-22323, filed on Apr. 23, 2002, the contents of which are herein incorporated by reference in their entirety.

BACKGROUND OF THE INVENTION

1. Field of the Invention

The present invention relates to an integrated circuit for driving a Liquid Crystal Display (LCD) and more particularly, to a circuit for generating a driving voltage in an LCD driving integrated circuit (referred to as an LCD driver IC).

2. Description of the Related Art

An LCD is a display device used in portable communication devices or home appliances such as handheld computers and personal digital assistants. LCDs display data utilizing the principle that optical transmissivity changes according to the magnitude of voltages applied to both ends of the liquid panel. There are generally two categories of LCDs, namely, STN (Super Twisted Nematic)-LCD and TFT (Thin Film Transistor)-LCD. The methods for driving these LCDs are different.

An LCD driver IC is an IC used to generate a driving voltage required for displaying data on LCD panel. In general, there are electrodes at both ends of the liquid panel, to which a voltage is applied. An electrode at one end of the panel is referred to as the common electrode and an electrode at the other end of the panel is referred to as the segment electrode. A voltage input to the common electrode is referred to as the common voltage and a voltage input to the segment electrode is referred to as the segment voltage.

The LCD driver IC is designed to receive characters or an image to be displayed on an LCD, convert the data of the characters or image into a segment voltage and a common voltage, and apply the converted voltages to the LCD panel.

In general, there are six levels of driving voltages input into a common electrode and a segment electrode of an LCD panel. A circuit for generating a driving voltage generates the six levels of driving voltages. It is important to generate the driving voltages effectively with low power consumption.

FIG. 1 is a block diagram showing a driving voltage generating circuit of a conventional LCD driver IC. The circuit in FIG. 1 is a circuit used for a conventional STN-LCD driver IC. The conventional LCD driving voltage generating circuit 100 includes a DC-DC converter 110, a voltage divider 120 and an oscillator 130. The DC-DC converter 110 is a circuit referred to as a voltage booster and generates a first driving voltage V0 by amplifying a received input voltage VCI by a predetermined amount. The first driving voltage V0 is a high voltage required for driving the LCD panel 140.

Basically, the DC-DC converter 110 boosts a voltage by charging a capacitor with an electric charge via switching and pumping of electric charge. A clock signal CK with a certain period is used as a switching signal required for switching. The clock signal CK is generated in the oscillator 130. The first driving voltage V0 generated by the DC-DC converter 110 is divided by the voltage divider 120 and output as the second through fifth driving voltages V1-V4.

When the LCD panel 140 is driven, power or current consumption in a panel changes according to display patterns, so the level of the first driving voltage V0 also changes. In other words, if the current consumption of the panel is low, the level of the first driving voltage V0 is maintained. However, if the current consumption of the panel is high, the level of the first driving voltage V0 is greatly decreased.

As described above, if the current consumption changes depending on the display patterns and the level of the first driving voltage V0 changes depending on current consumption, the brightness of a display changes depending on the display patterns. It is important to boost the first driving voltage V0 to a certain level because the second through fifth driving voltages V1-V4 are generated based on the first driving voltage V0.

However, if the DC-DC converter 1 10 uses a fixed frequency clock signal CK, as in the case of using the conventional driving voltage generating circuit 100 shown in FIG. 1, boosting is not performed effectively. Efficiency of voltage booster is influenced by power consumption and boosting efficiency. Namely, it is preferable to use a DC-DC converter which has low power consumption and high boosting efficiency.

It is noted that boosting efficiency, namely a ratio of a target value of the first driving voltage V0 to the first driving voltage V0 is represented as a percentage. Namely, if the target value of the first driving voltage is 10V, and the level of the first driving voltage V0 goes below 8V, the boosting efficiency is 80%. Accordingly, the first driving voltage V0 needs to be maintained at a desired level to increase boosting efficiency regardless of a load of the LCD panel 140.

In general, if the current consumption of the LCD panel 140 is low, it is possible to obtain sufficient boosting efficiency using a clock signal CK having a very low frequency. On the other hand, as the current consumption of the LCD panel 140 increases, the frequency of the clock signal CK needs to be increased to increase boosting efficiency.

However, the conventional driving voltage generating circuit 100 uses a clock signal having a fixed frequency. If current consumption of the LCD panel 140 is low, current is unnecessarily consumed by the DC-DC converter 110. In general, if the frequency of the clock signal CK is high, the current used by the DC-DC converter 110 increases.

On the other hand, if the current consumption of the LCD panel 140 is very high, a clock signal CK having a relatively high frequency is required. However, the conventional driving voltage generating circuit 100 performs voltage boosting with a clock signal having a fixed frequency, dropping the level of the first driving voltage V0. Therefore, display quality is decreased.

SUMMARY OF THE INVENTION

It is an object of the present invention to provide an LCD driving voltage generating circuit in which display quality is not decreased regardless of an increase in current consumption of the LCD panel, by reducing power consumption and improving boosting efficiency.

It is another object of the present invention to provide a method for generating an LCD driving voltage applied to the LCD driving voltage generating circuit.

To achieve the first object of the present invention, there is provided a liquid crystal display (LCD) driving voltage generating circuit. The circuit comprises a DC-DC converter for boosting an input voltage to generate a first driving voltage in response to a clock signal. A voltage controlled oscillator generates the clock signal at a frequency that changes in response to the level of a control voltage. A control voltage generator generates the control voltage in response to a difference between a reference voltage and a feedback voltage derived from the first driving voltage.

In one embodiment, the driving voltage generating circuit further comprises a feedback voltage divider for generating the feedback voltage by dividing the first driving voltage. The driving voltage generating circuit may further comprise a comparator which compares the feedback voltage and the reference voltage and generates an enable signal, and the DC-DC converter further operates in response to the enable signal.

The control voltage generator may further include a voltage amplifier that amplifies the difference between the reference voltage and the feedback voltage. The driving voltage generating circuit may further comprise a driving voltage divider for dividing the first driving voltage into second through fifth driving voltages, and for outputting second through fifth driving voltages along with the first driving voltage and a ground voltage.

The DC-DC converter may further comprise at least one first switch that is activated in response to a first switching signal; at least one second switch in series with the first switch that is activated in response to a second switching signal; at least one first capacitor coupled between the first switch and a terminal of the clock signal; and at least one second capacitor coupled between the second switch and a terminal of an inverted signal of the clock signal.

The voltage controlled oscillator may comprise an inverter chain comprising a plurality of inverters connected in series; a plurality of resistors which are electrically connected to the output terminals of the plurality of inverters, the resistors having resistance values that change in response to the control voltage; and a plurality of capacitors coupled between the plurality of resistances and a ground source. Each of the plurality of-resistors may comprise MOS transistors and the control voltage is applied to the gates of the individual MOS transistors.

To further achieve the first object, there is provided a liquid crystal display (LCD) driving voltage generating circuit. The circuit comprises a DC-DC converter for boosting an input voltage to generate a first driving voltage in response to a clock signal. An oscillator generates the clock signal. A driving voltage divider divides the first driving voltage into a plurality of divided driving voltages having a lower voltage level than the voltage level of the first driving voltage, and outputs the first driving voltage and the plurality of divided driving voltages. The frequency of the clock signal changes depending on a load coupled to the first driving voltage and the plurality of divided driving voltages.

In one embodiment, the frequency of the clock signal increases as the load increases.

The driving voltage generating circuit may further comprise a control voltage generator for generating a control voltage related to the load based on a difference between a reference voltage and a feedback voltage that is based on the first driving voltage. The oscillator comprises a voltage controlled oscillator for generating the clock signal at a frequency that changes in response to the level of the control voltage. The control voltage increases as a difference between the feedback voltage and the reference voltage increases. The DC-DC converter further operates in response to an enable signal. The circuit activates the enable signal if the feedback voltage is less than the reference voltage.

To achieve the second object of the present invention, there is provided a method for generating an LCD driving voltage. An input voltage is boosted in response to a clock signal and the boosted voltage is output as a first driving voltage. The first driving voltage is divided into a plurality of divided driving voltages having a lower level than the level of the first driving voltage, and the plurality of divided driving voltages are output. The clock signal frequency is changed in response to a load coupled to the first driving voltage and the plurality of divided driving voltages.

The frequency of the clock signal preferably increases as the load increases. The step of changing the frequency of the clock signal may comprise: generating a feedback voltage by dividing the first driving voltage; generating a control voltage related to the load using a value between the reference voltage and the feedback voltage; and changing the frequency of the clock signal in response to the control voltage.

In another aspect, the present invention is directed to a liquid crystal display (LCD) module for displaying image data. The module comprises a voltage generating circuit for generating a plurality of voltages and an LCD panel for receiving the plurality of voltages and displaying the image data, The voltage generating circuit comprises a DC-DC converter for boosting an input voltage to generate a first driving voltage in response to a clock signal. A voltage controlled oscillator generates the clock signal, which has a frequency that changes depending on the level of a predetermined control voltage. A control voltage generator generates the control voltage using a difference between a predetermined reference voltage and a feedback voltage reflecting the first driving voltage.

In one embodiment, the voltage generating circuit further comprises a feedback voltage divider for generating a feedback voltage by dividing the first driving voltage. The voltage generating circuit may further comprise a comparator which compares the feedback voltage and the reference voltage and generates an enable signal, and the DC-DC converter operates in response to the enable signal.

In another aspect, the present invention is directed to a display device, comprising: a liquid crystal display (LCD); and an LCD driving circuit, wherein the LCD driving circuit comprises an LCD driving voltage generating circuit. The LCD driving voltage generating circuit comprises: a DC-DC converter for boosting an input voltage to generate a first driving voltage in response to a clock signal; a voltage controlled oscillator for generating the clock signal at a frequency that changes in response to the level of a control voltage; and a control voltage generator for generating the control voltage in response to a difference between a reference voltage and a feedback voltage derived from the first driving voltage.

In another aspect, the present invention is directed to a portable communication device, comprising: a liquid crystal display (LCD); and an LCD driving circuit, wherein the LCD driving circuit comprises an LCD driving voltage generating circuit. The LCD driving voltage generating circuit comprises: a DC-DC converter for boosting an input voltage to generate a first driving voltage in response to a clock signal; a voltage controlled oscillator for generating the clock signal at a frequency that changes in response to the level of a control voltage; and a control voltage generator for generating the control voltage in response to a difference between a reference voltage and a feedback voltage derived from the first driving voltage.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF PREFERRED EMBODIMENTS

Figure 1:
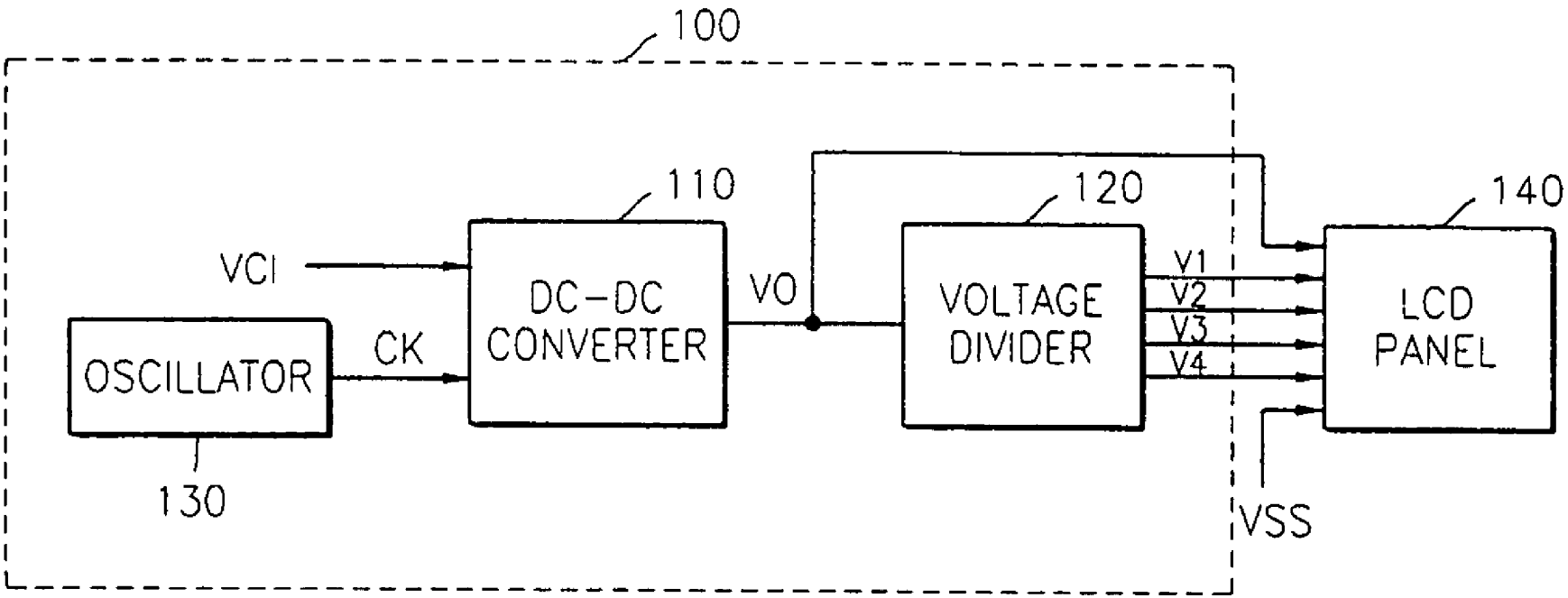
FIG. 1 (PRIOR ART)
FIG. 1 is a block diagram showing a conventional circuit for generating a driving voltage of the LCD driver IC.

The present invention will now be described more fully with reference to the accompanying drawings, in which preferred embodiments of the invention are shown. Like reference numerals in different drawings refer to like elements.

First, the relationship between boosting efficiency and the frequency of a clock signal used for boosting voltages is described. The frequency of the clock signal is referred to herein as "boosting frequency".

Figure 2:
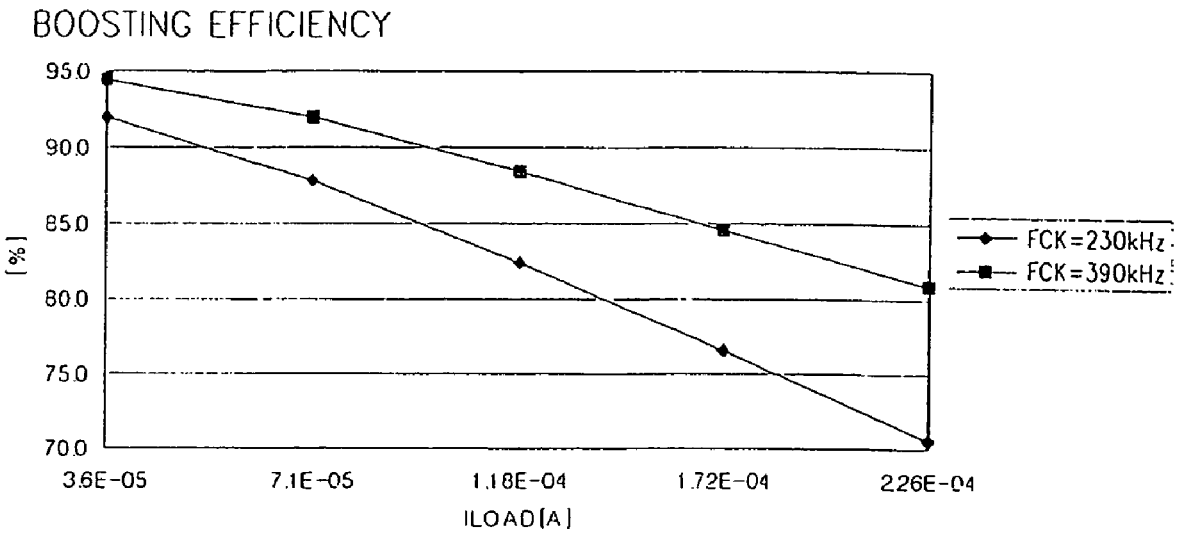
FIG. 2 is a graph illustrating boosting efficiency according to the amount of current consumed by an LCD panel for different frequencies of a clock signal, in accordance with the present invention.

FIG. 2 is a graph illustrating the relationship between boosting efficiency and current consumption ILOAD of an LCD panel according to the frequency FCK of the clock signal. Referring to FIG. 2, if the current consumption ILOAD of the LCD panel increases, boosting efficiency is decreased, regardless of the value of the frequency FCK of the clock signal. However, if the frequency FCK of the clock signal is 390KHz, the effect on boosting efficiency due to an increase in current consumption ILOAD is much less than the case where the frequency FCK of the clock signal is 230KHz. In other words, if the frequency of the clock signal is 230KHz, the level of the first driving voltage V0 decreases greatly with an increase in the current consumption ILOAD. On the contrary, if the frequency of the clock signal is 390KHz, the level of the first driving voltage V0 is decreased a relatively small amount as the amount of current consumption is increased. Thus, in the case where current consumption ILOAD of the LCD panel is high, boosting efficiency is improved by increasing the boosting frequency FCK.

On the other hand, in the case where the current consumption ILOAD of the LCD panel is very low, boosting efficiency is not influenced greatly by increasing the boosting frequency FCK. It is noticed that it is effective to change the boosting frequency FCK according to current consumption ILOAD of the LCD panel in view of boosting efficiency and power consumption as shown in the result of the experiment of FIG. 2.

Figure 3:
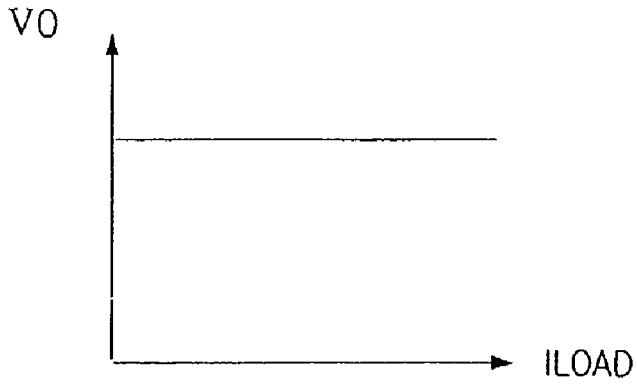
FIG. 3 is a view showing an ideal level of the first driving voltage according to the amount of current consumption of an LCD panel.

Accordingly, when the load of the LCD panel changes, the boosting frequency FCK can be changed to an optimum frequency according to the load (namely, current consumption) of the LCD panel to maintain the level of the driving voltage. It is preferable that the boosting efficiency is not decreased and the level of the first driving voltage V0 is maintained at a certain level, even though current consumption is changed, as shown in FIG. 3.

Figure 4:
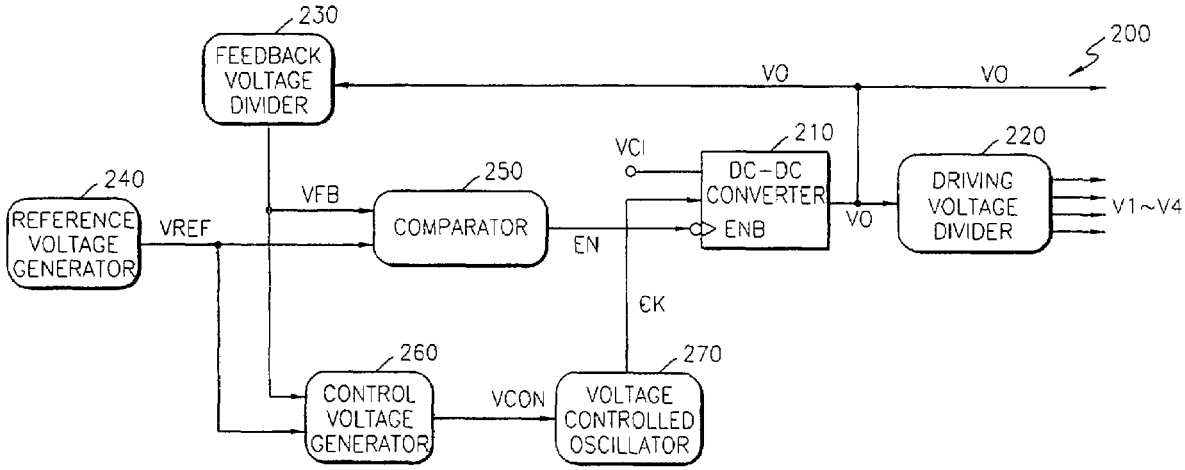
FIG. 4 is a block diagram showing an LCD driving voltage generating circuit according to an embodiment of the present invention.

FIG. 4 is a block diagram of an LCD driving voltage generating circuit 200 according to an embodiment of the present invention. Referring to FIG. 4, the driving voltage generating circuit 200 according to an embodiment of the present invention includes a DC-DC converter 210, a driving voltage divider 220, a feedback voltage divider 230, a reference voltage generator 240, a comparator 250, a control voltage generator 260 and a voltage controlled oscillator 270.

The DC-DC converter 210 receives and boosts an input voltage VCI and generates the first driving voltage V0. The DC-DC converter 210 boosts the input voltage VCI by pumping electric charge in response to a clock signal only when enabled by an enable signal EN. The DC-DC converter 210 boosts the input voltage VCI to a voltage that is a predetermined number of times larger than VCI. (referred to herein as the "boosting factor")

For example, if the DC-DC converter 210 is embodied to have a 3V input voltage and a boosting factor of four, it can generate a maximum first driving voltage V0 of about 12V. If the first driving voltage V0 required for the LCD panel is about 9V, which is lower than the maximum voltage 12V of the first driving voltage V0, it would be unnecessary to boost the driving voltage to about 12V because the high voltage required for driving the LCD panel is only about 9V. Accordingly, it is desirable to stop the first driving voltage V0 from boosting if it reaches the target value, about 9V, in order to prevent unnecessary power consumption.

As described above, the DC-DC converter 210 is embodied to operate in response to the activation of an enable signal EN in order to boost the input voltage VCI, only if the first driving voltage V0 is lower than a target value.

The comparator 250 compares a feedback voltage VFB and a reference voltage VREF and generates the enable signal EN that controls the boosting of the DC-DC converter 210. Namely, the comparator 250 generates an enable signal EN that is activated if the feedback voltage VFB reflecting the first driving voltage V0 is less than the reference voltage VREF. The enable signal EN is then provided as an input to, and controls the operation of, the DC-DC converter 210. It is preferable that the feedback voltage divider 230 generates the feedback voltage VFB by driving the first driving voltage V0.

A clock signal CK required for boosting the DC-DC converter 210 is output from the voltage controlled oscillator 270. The voltage control oscillator 270 generates a clock signal CK having a frequency that changes according to the level of a control voltage VCON. The level of the control voltage VCON changes depending on the difference between the feedback voltage VFB reflecting the first driving voltage V0 and the reference voltage.

The feedback voltage divider 230 divides the first driving voltage V0 and generates the feedback voltage VFB. Namely, the feedback voltage divider 230 divides the first driving voltage V0, generates a feedback voltage VFB and provides it to the comparator 250 and the control voltage generator 260.

The reference voltage generator 240 generates a reference voltage VREF that is input to the comparator 250 and the control voltage generator 260. It is preferable that the reference voltage generator 240 is designed to be insensitive to fluctuations in power, voltage, temperature, etc.

The driving voltage divider 220 receives and divides the first driving voltage. V0 and outputs the second through fifth driving voltages V1-V4. The first through fifth driving voltages V0-V4 and a grounding voltage VSS are input by an LCD panel, and used for driving the LCD panel.

Figure 5:
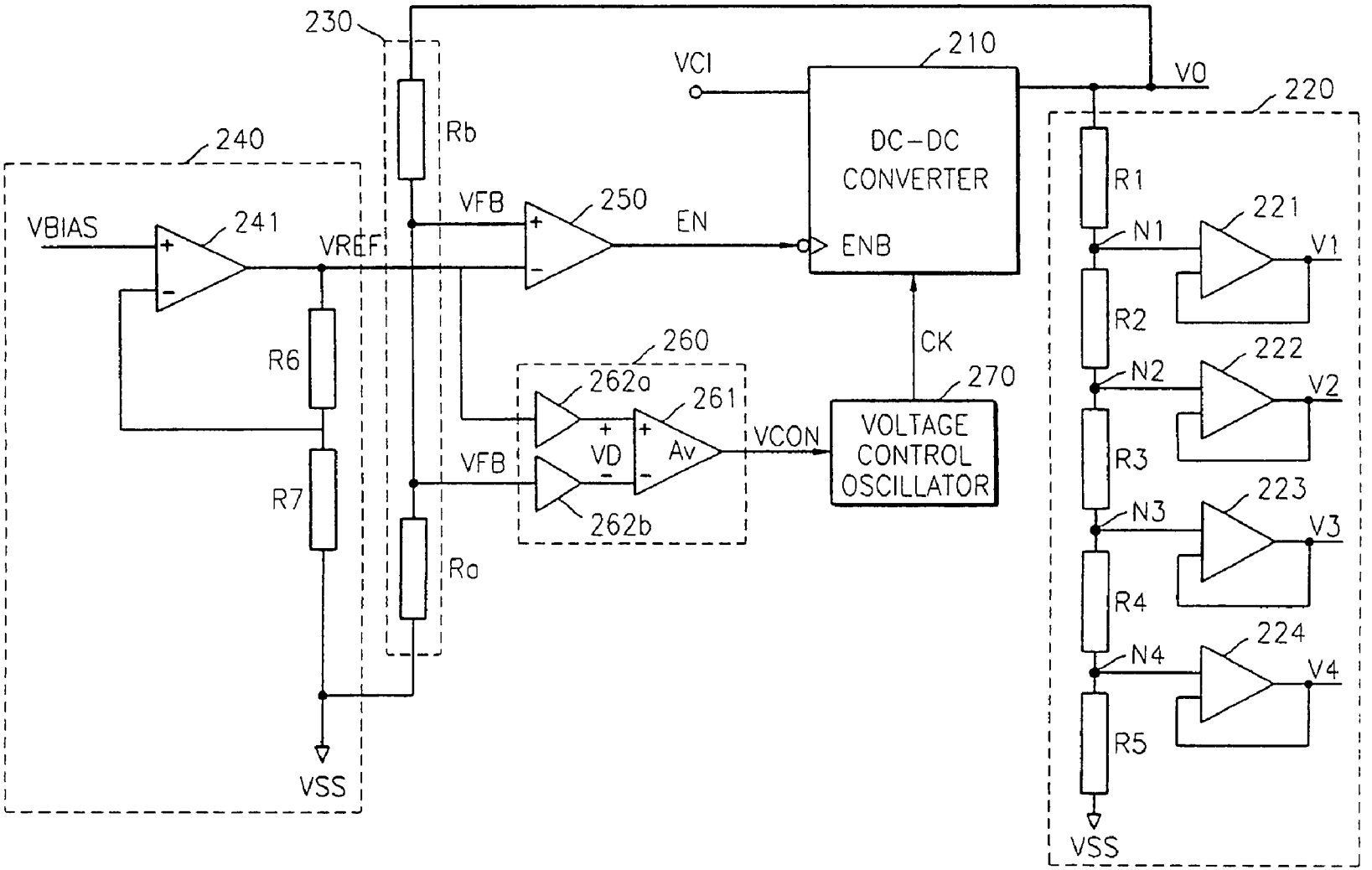
FIG. 5 is a detailed schematic diagram of an LCD driving voltage generating circuit according to an embodiment of the present invention.
Figure 6:
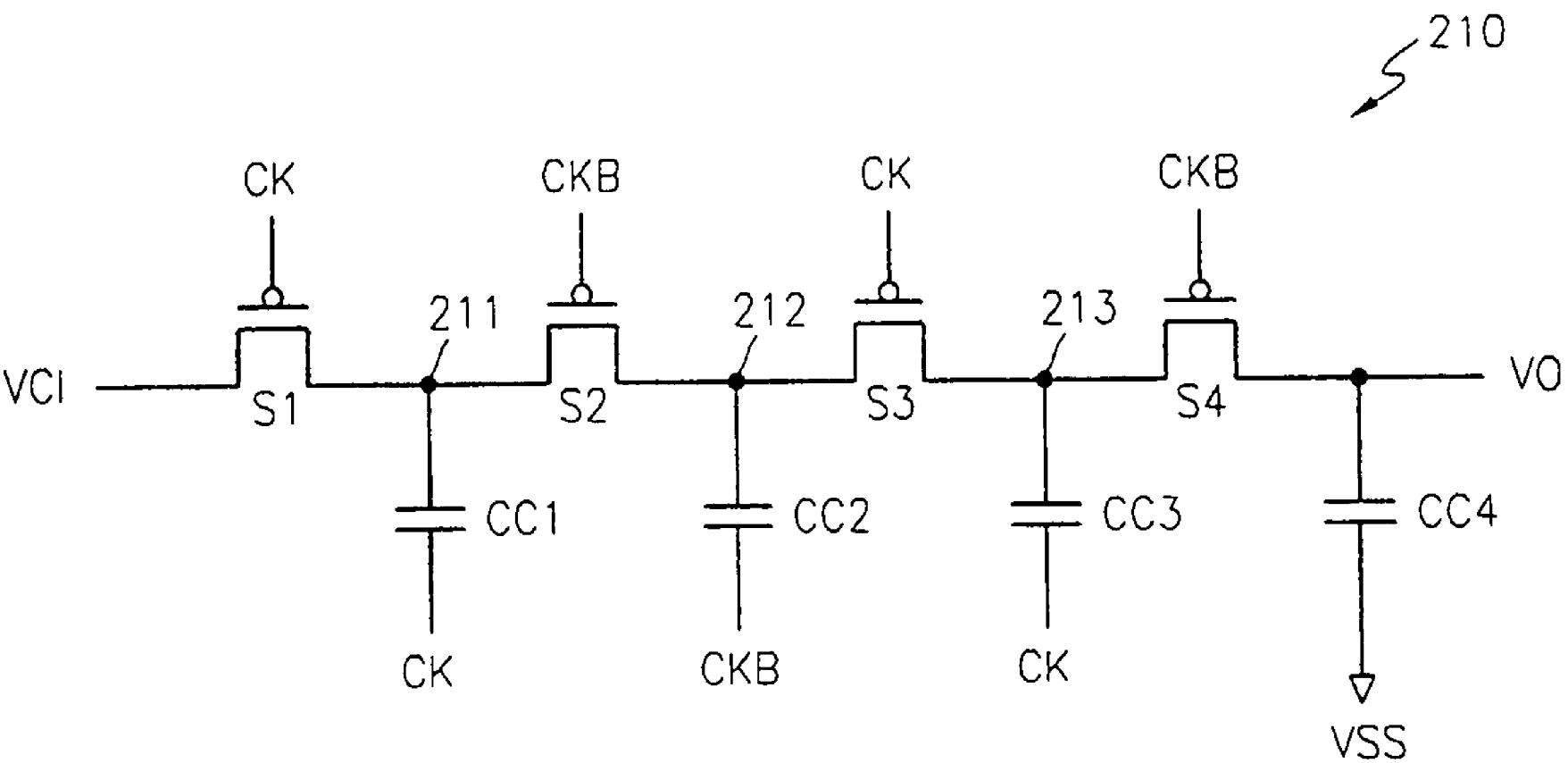
FIG. 6 is a circuit diagram showing a detailed configuration of a DC-DC converter shown in FIG. 4.

FIG. 5 is a detailed schematic block diagram of a driving voltage generating circuit 200 according to an embodiment of the present invention. FIG. 6 is a schematic block diagram of the DC-DC converter 210. Referring to FIG. 5, the driving voltage divider 220 includes first through fifth distributing resistors R1-R5 and first through fourth voltage followers 221-224. The first through the fifth distributing resistors R1-R5 are connected in series between the first driving voltage V0 and the grounding voltage VSS. The first distributing resistor R1 is positioned between the first driving voltage V0 and a first node N1, the second distributing resistor R2 is positioned between the first node N1 and a second node N2, the third distributing resistor R3 is positioned between the second node N2 and a third node N3, the fourth distributing resistor R4 is positioned between the third node N3 and a fourth node N4, and the fifth distributing resistor R5 is positioned between the fourth node N4 and the grounding voltage VSS. The voltages of each node N1-N4 are output as the second through fifth driving voltages V1-V4 through the voltage followers 221-224.

Accordingly, the second through fifth driving voltages V1-V4 become voltages having levels that are between the first driving voltage V0 and the grounding voltage VSS. The feedback voltage divider 230 includes two distributing resistors Ra and Rb. The feedback voltage VFB generated by the feedback voltage divider 230 is determined by the ratio of the distributing resistors Ra and Rb and the value of the first driving voltage V0. It is preferable that the values of the distributing resistors Ra and Rb are set so that the feedback voltage VFB and the reference voltage VREF are the same if the first driving voltage V0 is a predetermined target value.

The reference voltage generator 240 is embodied using an operational amplifier which receives a bias voltage VBIAS through a positive (+) terminal, and a second feedback voltage through a negative terminal (−). The second feedback voltage is generated by dividing the reference voltage VREF using two resistors R6 and R7.

The comparator 250 receives the feedback voltage VFB through a positive (+) terminal and the reference voltage VREF through a negative (−) terminal. If the feedback voltage VFB is higher than the reference voltage VREF, an enable signal EN having a high level is output and if the feedback voltage VFB is lower than the reference voltage VREF, an enable signal EN having a low level is output. The DC-DC converter 210 performs a boosting operation on the voltage V0, in response to the enable signal EN being at a low level.

Therefore, the comparator 250 generates the enable signal EN for enabling the DC-DC converter 210 if the feedback voltage VFB is lower than the reference voltage VREF. A feedback voltage VFB which is lower than the reference voltage VREF indicates that the first driving voltage V0 is lower than a desired target value. Therefore, if the first driving voltage V0 is lower than the target value, the enable signal EN is activated to a low level. Thus, the first driving voltage V0 is increased by boosting of the DC-DC converter 210. If the output of the DC-DC converter 210 is higher than the target value, the feedback voltage VFB is higher than the reference voltage VREF. Therefore, the enable signal EN is deactivated so that boosting of the DC-DC converter 210 is halted.

The control voltage generator 260 includes a voltage amplifier 261, and two buffers 262*a* and 262*b*. The buffers 262*a* and 262*b* buffer the reference voltage VREF and the feedback voltage VFB, respectively. The voltage amplifier 261 generates a voltage which is proportional to the difference between the reference voltage VREF and the feedback voltage VFB. Accordingly, a control voltage VCON having a higher level is generated if the feedback voltage VFB is lower than the reference voltage VREF, and a control voltage VCON having a lower level is generated if the feedback voltage VFB is higher than the reference voltage VREF. A feedback voltage VFB which is lower than the reference voltage VREF indicates that the first driving voltage V0 is lower than the target value. In addition, if the first driving voltage V0 is lower than the target value, this can indicate that there is a large load in the LCD panel.

Figure 7:
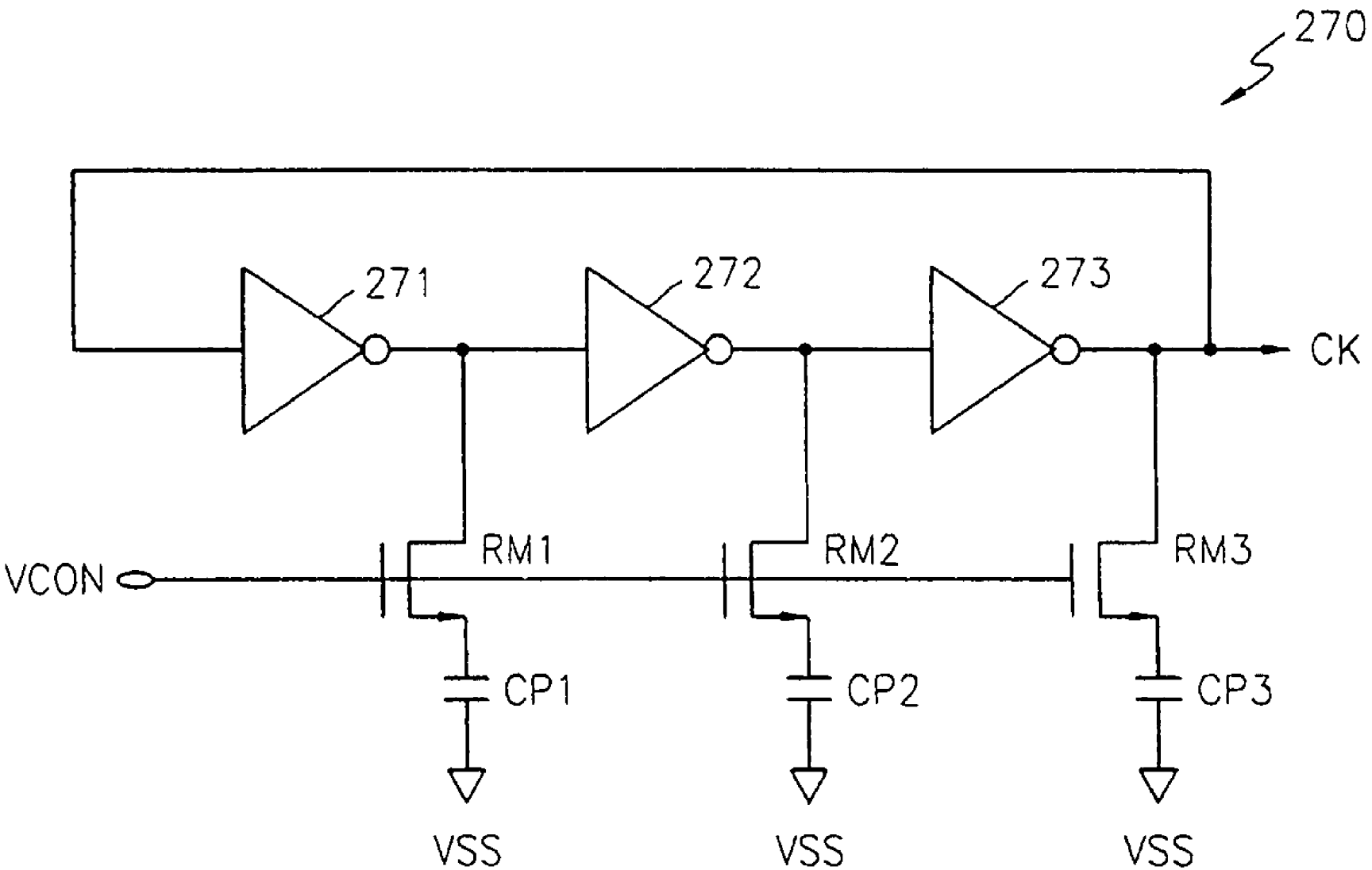
FIG. 7 is a circuit diagram showing a detailed configuration of a voltage controlled oscillator shown in FIG. 4.

The voltage amplifier 261 can be embodied as an operational amplifier for receiving the reference voltage VREF through a positive (+) terminal and the feedback voltage VFB through a negative (−) terminal. A control voltage VCON output from the voltage amplifier 261 is input to the voltage controlled oscillator 270. The voltage controlled oscillator 270 generates a clock signal CK having a frequency which changes depending on the level of the input control voltage VCON. Namely, if the level of the control voltage VCON is higher, a clock signal having a higher frequency is generated. If the level of the control voltage VCON is lower, a clock signal having a lower frequency is generated. A detailed configuration of the voltage controlled oscillator 270 is shown in FIG. 7.

FIG. 6 is a detailed schematic diagram of an embodiment of the DC-DC converter 210. However, the DC-DC converter 210 of the present invention is not limited to the embodiment of FIG. 6, and can take any of a number of suitable forms. The DC-DC converter 210 includes at least one switch and a capacitor. In this embodiment the DC-DC converter 210 includes four switches and four capacitors. The four switches included in the DC-DC converter 210 are referred to as first through fourth switches S1-S4, and the four capacitors are referred to as first through fourth capacitors CC1-CC4.

In one embodiment, the first through fourth switches S1-S4 are MOS transistors for receiving switching signals through gates, in FIG. 6, the first through fourth switches S1-S4 are embodied as PMOS transistors. The first through the fourth switches S1-S4 are connected between an input voltage VCI terminal and an output voltage terminal (namely, the first driving voltage V0) in series. In addition, the output terminals of the first through the fourth switches S1-S4 are connected to the first through fourth capacitors CC1-CC4.

The first and the third switches S1 and S3 receive the clock signal CK as switching signals, and the second and the fourth switches S2 and S4 receive an inverted clock signal CKB as switching signals. In addition, the opposite terminals of the first and third capacitors CC1 and CC3 receive the clock signal CK, and the second capacitor CC2 receives the inverted clock signal CKB. It is preferable that the clock signal CK is a signal which swings between the grounding voltage VSS and the input voltage VCI levels.

In this manner, the voltage level at the first switching node 211 swings between the input voltage VCI level and two times the input voltage level 2VCI, the voltage level at the second switching node 212 swings between two times the input voltage level 2VCI and three times the input voltage level 3VCI, and the voltage level of the third switching node 213 swings between three times the input voltage level 3VCI and four times the input voltage level 4VCI. Accordingly, the level of the first driving voltage V0 is almost three times that of the input voltage VCI. Namely, the DC-DC converter 210 in FIG. 6 is a circuit designed to boost a voltage by a factor of three.

The boosting factor can be changed depending on the number of stages. Here, the number of stages is determined by the number of capacitors connected to a clock signal CK or an inverted clock signal CKB. In FIG. 6, the number of stages is three.

FIG. 7 is a schematic diagram of an embodiment of the voltage controlled oscillator 270 shown in FIG. 4. There are many different ways to embody a voltage controlled oscillator 270. The embodiment shown comprises a ring oscillator, where the value of the effective capacitance in an output node of an inverter chain changes, using a resistor whose resistance changes depending on applied voltage.

Referring to FIG. 7, the voltage controlled oscillator 270 includes an inverter chain including a plurality of inverters 271, 272, and 273 connected in series; a plurality of resistors RM1, RM2, and RM3 connected to the output nodes of each inverter; and a plurality of capacitors CP1, CP2, and CP3 formed between the resistors RM1, RM2, and RM3 and the grounding voltage VSS, respectively.

The output of the inverter chain is a clock signal CK having a boosting frequency FCK. The output of the inverter chain is fed back to the input of the inverter chain. It is preferable that the resistances RM1, RM2, and RM3 are NMOS transistors that receive a control voltage VCON through their gates. The drains of the transistors RM1, RM2, and RM3 are connected to the outputs of the inverters 271, 272 and 273, respectively, and the sources of the transistors RM1, RM2, and RM3 are connected to the capacitors CP1, CP2, CP3, respectively. The resistance value of each of the NMOS transistors decreases as the level of the control voltage VCON applied to the gate is increased, arid increases as the level of the control voltage VCON applied to the gate is decreased. The effective capacitance at the inverter output node changes according to changes in the level of the control voltage VCON.

As described above, the resistance value of transistors RM1, RM2, and RM3 changes according to the applied control voltage VCON. A delay value between the output signal and the input signal of the inverter changes as the effective capacitance changes. Accordingly, the frequency of the clock signal CK which is output from the inverter chain changes.

If the control voltage VCON is high, the resistance of the transistors RM1, RM2, and RM3 decreases. Thus, the delay time decreases and the frequency of the clock signal CK increases. On the other hand, if the control voltage VCON is low, the resistance of the transistors RM1, RM2, and RM3 increases. Thus, delay time increases and the frequency of the clock signal CK decreases.

Figure 8:
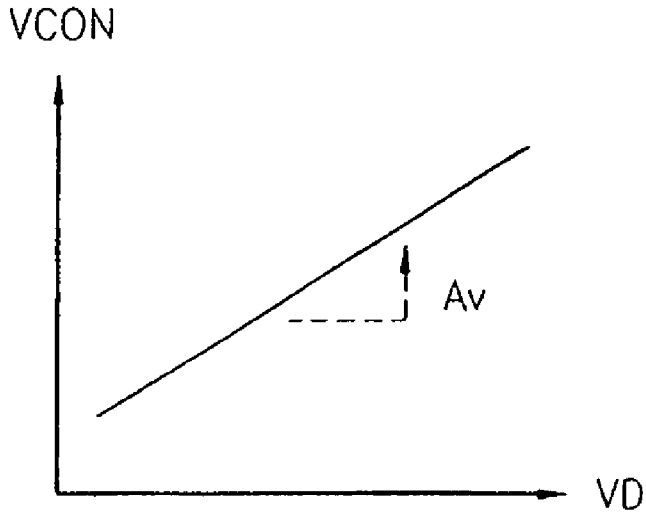
FIG. 8 is a graph of characteristics of the voltage amplifier shown in FIG. 5.

FIG. 8 is a graph demonstrating features of the voltage amplifier 261 of the control voltage generator 260 shown in FIG. 5. The voltage amplifier 261 generates a control voltage VCON. The level of the control voltage VCON increases in proportion to a difference voltage VD between the reference voltage VREF and the feedback voltage VFB. The slope is referred to as voltage gain Av.

Figure 9:
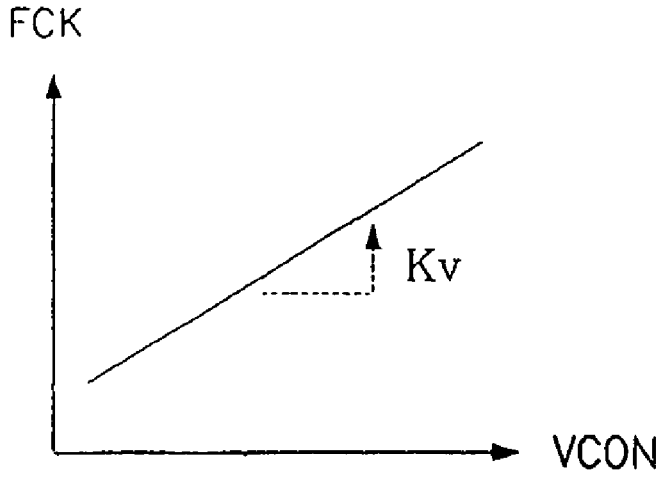
FIG. 9 is a graph of characteristics of the voltage controlled oscillator shown in FIG. 4.

FIG. 9 is a graph demonstrating features of the voltage controlled oscillator 270 shown in FIG. 4. Referring to FIG. 9, the frequency FCK of the clock signal output from the voltage controlled oscillator 270 changes in proportion to the input control voltage VCON. The slope is referred to as voltage-frequency sensitivity Kv.

It is noted that the range over which the frequency FCK of the clock signal changes is determined by the voltage gain Av of the voltage amplifier 261 of the controlled voltage generator 260 and voltage-frequency sensitivity Kv of the voltage controlled oscillator 270. If the range over which a boosting frequency changes is set to be small, the voltage gain Av of the voltage amplifier of the control voltage generator 260 is set to be small. The voltage amplifier 261 can therefore be used as an attenuator for a particular case.

Figure 10:
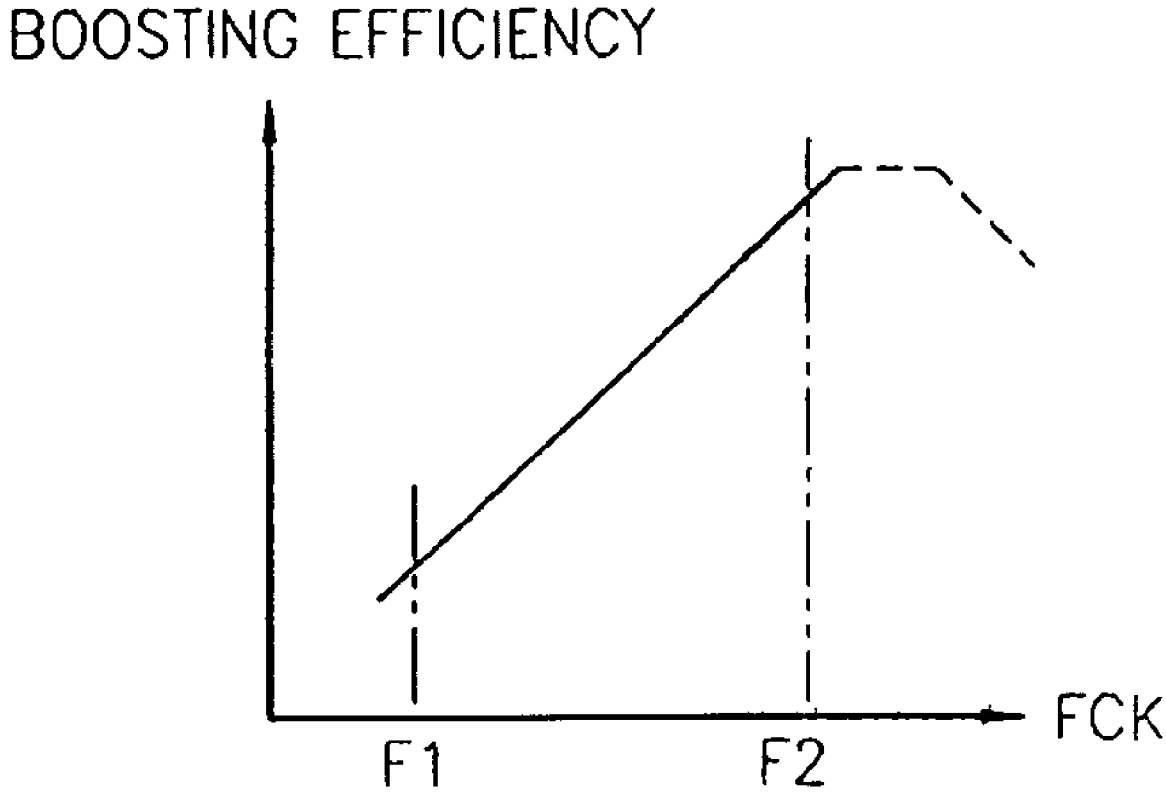
FIG. 10 is a graph of characteristics of boosting efficiency with respect to frequencies of a clock signal in the driving voltage generating circuit shown in FIG. 4.

FIG. 10 is a graph that demonstrates system boosting efficiency in response to the frequency FCK of the clock signal. Referring to FIG. 10, as the frequency FCK of the clock signal increases, boosting efficiency is increased up-to a certain frequency (F2 in FIG. 10). As described above, boosting efficiency, which is found by the ratio of a target value of the first driving voltage V0 to the real first driving voltage V0, is represented as a percentage.

Referring to FIG. 10, if the frequency FCK of the clock signal is greater than a certain critical value, boosting efficiency is not increased, and is maintained or decreased with increasing boosting frequency FCK. That is, if the frequency FCK of the clock signal is greatly increased, the boosting efficiency of the DC-DC converter 210 decreases. In other words, as the boosting frequency increases, efficiency decreases as the increase of current consumed in the DC-DC converter 210 becomes more dominant. Thus, if the boosting frequency FCK increases, a further increase in efficiency is not possible.

Therefore, it is possible that the frequency FCK of the clock signal can be controlled to be within the linear range F1-F2 as shown in FIG. 10. As described above, the range of the frequency of the clock signal CK can be controlled by adjusting the voltage gain Av and/or the voltage-frequency sensitivity Kv as shown in FIG. 8 and FIG. 9.

It is noted that the present invention is not limited to the preferred embodiment described above, and it is apparent that variations and modifications can be made by those skilled in the art within the spirit and scope of the present invention defined in the appended claims.

According to the present invention, it is possible to reduce the amount of waste current consumed by the DC-DC converter by driving the DC-DC converter with a very low boosting frequency, in the case where current consumption of an LCD panel is low, for example during character display. On the other hand, it is possible to increase the boosting efficiency by preventing the level of the driving voltage from decreasing, by increasing the boosting frequency, in the case where the current consumption of the LCD panel is high, for example during the display of moving images.

Therefore, it is possible to maintain display quality, while reducing power consumption and improving boosting efficiency even though current consumption of the LCD panel increases.

What is claimed is:

1. A display device, comprising:

a liquid crystal display (LCD); and an LCD driving circuit, wherein the LCD driving circuit comprises an LCD driving voltage generating circuit, the LCD driving voltage generating circuit comprising:

a DC-DC converter for boosting an input voltage to generate a first driving voltage in response to a clock signal;

a voltage controlled oscillator for generating the clock signal at a frequency that changes in response to the level of a control voltage; and a control voltage generator for generating the control voltage in response to a difference between a reference voltage and a feedback voltage derived from the first driving voltage.

2. The circuit of claim 1, wherein the LCD driving voltage generating circuit further comprises a feedback voltage divider for generating the feedback voltage by dividing the first driving voltage.

3. The circuit of claim 1, wherein the LCD driving voltage generating circuit further comprises a comparator which compares the feedback voltage and the reference voltage and generates an enable signal, and wherein the DC-DC converter further operates in response to the enable signal.

4. The circuit of claim 1, wherein the control voltage generator includes a voltage amplifier that amplifies the difference between the reference voltage and the feedback voltage.

5. The circuit of claim 1, wherein the LCD driving voltage generating circuit further comprises a driving voltage divider for dividing the first driving voltage into second through fifth driving voltages, and, for outputting second through fifth driving voltages along with the first driving voltage and a ground voltage.

6. The circuit of claim 1, wherein the DC-DC converter comprises;

at least one first switch that is activated in response to a first switching signal;

at least one second switch in series with the first switch that is activated in response to a second switching signal;

at least one first capacitor coupled between the first switch and a terminal of the clock signal; and at least one second capacitor coupled between the second switch and a terminal of an inverted signal of the clock signal.

7. The circuit of claim 1, wherein the voltage controlled oscillator comprises;

an inverter chain comprising a plurality of inverters connected in series;

a plurality of resistors which are electrically connected to the output terminals of the plurality of inverters, the resistors having resistance values that change in response to the control voltage; and a plurality of capacitors coupled between the plurality of resistances and a ground source.

8. The circuit of claim 7, wherein each of the plurality of resistors comprises MOS transistors and wherein the control voltage is applied to the gates of the individual MOS transistors.

9. A portable communication device, comprising:

a liquid crystal display (LCD); and an LCD driving circuit, wherein the LCD driving circuit comprises an LCD driving voltage generating circuit, the LCD driving voltage generating circuit comprising:

a DC-DC converter for boosting an input voltage to generate a first driving voltage in response to a clock signal;

a voltage controlled oscillator for generating the clock signal at a frequency that changes in response to the level of a control-voltage; and a control voltage generator for generating the control voltage in response to a difference between a reference voltage and a feedback voltage derived from the first driving voltage.

10. The circuit of claim 9, wherein the LCD driving voltage generating circuit further comprises a feedback voltage divider for generating the feedback voltage by dividing the first driving voltage.

11. The circuit of claim 9, wherein the LCD driving voltage generating circuit further comprises a comparator which compares the feedback voltage and the reference voltage and generates an enable signal, and wherein the DC-DC converter further operates in response to the enable signal.

12. The circuit of claim 9, wherein the control voltage generator includes a voltage amplifier that amplifies the difference between the reference voltage and the feedback voltage.

13. The circuit of claim 9, wherein the LCD driving voltage generating circuit further comprises a driving voltage divider for dividing the first driving voltage into second through fifth driving voltages, and, for outputting second through fifth driving voltages along with the first driving voltage and a ground voltage.

14. The circuit of claim 9, wherein the DC-DC converter comprises;

at least one first switch that is activated in response to a first switching signal;

at least one second switch in series with the first switch that is activated in response to a second switching signal;

at least one first capacitor coupled between the first switch and a terminal of the clock signal; and at least one second capacitor coupled between the second switch and a terminal of an inverted signal of the clock signal.

15. The circuit of claim 9, wherein the voltage controlled oscillator comprises;

an inverter chain comprising a plurality of inverters connected in series;

a plurality of resistors which are electrically connected to the output terminals of the plurality of inverters, the resistors having resistance values that change in response to the control voltage; and a plurality of capacitors coupled between the plurality of resistances and a ground source.

16. The circuit of claim 15, wherein each of the plurality of resistors comprises MOS transistors and wherein the control voltage is applied to the gates of the individual MOS transistors.

* * * * *